United States Patent [19]

Hengesbach

[11] Patent Number: 4,494,699

[45] Date of Patent: Jan. 22, 1985

[54] ADJUSTABLE SPRAY NOZZLE

[76] Inventor: Robert W. Hengesbach, 7886 Mentor Rd., Mentor, Ohio 44060

[21] Appl. No.: 479,204

[22] Filed: Mar. 28, 1983

Related U.S. Application Data

[63] Continuation-in-part of Ser. No. 313,456, Oct. 21, 1981.

[51] Int. Cl.[3] ..... B05B 1/26

[52] U.S. Cl. ..... 239/499; 239/507; 239/514; 239/597

[58] Field of Search ..... 239/505, 513, 514, 499, 239/507, 597, 599

[56] References Cited

U.S. PATENT DOCUMENTS

| | | | |
|---|---|---|---|
| Re. 18,813 | 5/1933 | Buchanan | 239/597 X |
| 994,780 | 6/1911 | Olney | 239/597 X |
| 1,140,259 | 5/1915 | Elliott et al. | 239/499 X |
| 2,072,555 | 3/1937 | Hengesbach et al. | 239/11 |
| 2,747,931 | 5/1956 | Wilson | 239/505 X |
| 3,130,914 | 4/1964 | Carkin et al. | 239/499 X |
| 3,556,411 | 1/1971 | Nord et al. | 239/599 X |
| 3,632,046 | 1/1972 | Hengesbach | 239/318 |
| 3,756,273 | 9/1973 | Hengesbach | 137/540 |
| 4,349,947 | 9/1982 | Rood | 239/599 X |

OTHER PUBLICATIONS

Brochure 179F, Spraying Systems Co., 1971, 8 pp., Titled: Spray Nozzles, Spray Guns, Valves and Accessories.

Brochure 200A, Spraying Systems Co., 1982, 6 pp., Titled: "QuickJet", System.

Brochure 201, Spraying Systems Co., undated, 6 pp., Titled: GunJet.

Industrail Catalog 27, Spraying Systems Co., 1978, 90 pp., Titled: Spray Nozzles and Accessories.

*Primary Examiner*—John J. Love
*Assistant Examiner*—Mary F. McCarthy
*Attorney, Agent, or Firm*—David A. Burge

[57] ABSTRACT

A spray nozzle has an elongate tubular housing through which a gas-borne flow of liquid is ducted to a discharge opening that is formed in an end wall of the housing. The discharge opening is defined by the juncture of a transversely-extending, substantially linear groove which is formed in the external face of the end wall, and a converging passage which is formed in the internal face of the end wall. The converging passage and the linear groove cooperate to provide an essentially convergent-divergent discharge opening which tends to cause materials being discharged to form an elongate discharge spray pattern that is relatively narrow in width. Materials which discharge from the opening tend to travel in a relatively narrow range of planes that align with the linear groove, and tend to concentrate near opposite end portions of the discharge spray pattern. A deflector sleeve is carried by the housing and is adjustable longitudinally relative to the end wall of the housing. The sleeve is movable within a range of extended positions wherein the sleeve projects forwardly beyond the end wall of the housing to differing extents to intercept and deflect end portions of the discharge spray pattern to differing degrees such that opposite end portions of the discharging spray are deflected back into central portions of the spray pattern. The length of the resulting spray pattern is determined by the position of the sleeve relative to the end wall of the housing.

3 Claims, 11 Drawing Figures

ADJUSTABLE SPRAY NOZZLE

CROSS-REFERENCE TO RELATED APPLICATION

The present application is a continuation-in-part of application Ser. No. 313,456, filed Oct. 21, 1981, by Robert W. Hengesbach, entitled SPRAYING APPARATUS AND METHOD OF CONTROLLING RATE OF DISCHARGE OF MATERIALS THEREFROM, hereinafter referred to as the "Spraying Apparatus Case," the disclosure of which is incorporated herein by reference.

BACKGROUND OF THE INVENTION

1. Field of the Invention

The present invention relates generally to an adjustable spray nozzle which provides a relatively narrow but elongate spray pattern, the length of which is selectively controlled by utilizing an adjustable sleeve or the like to intercept and deflect end portions of an elongate but non-uniform discharge spray pattern back into a central portion of the spray pattern to provide a resulting spray pattern that is of controllable length, and which is relatively uniform along its length both with respect to spray pattern width and density.

2. Prior Art

Fixed configuration spray nozzles of a variety of types have been proposed for discharging gas-carried sprays of liquids such as paint, primer, sealer, rustproofing material, undercoating material and the like. One such fixed-configuration nozzle is disclosed in the referenced Spraying Apparatus Case, where a nozzle of fixed configuration is depicted as being carried at the end of an elongate wand of the type used to apply rustproofing and undercoating materials to vehicles.

Adjustable spray nozzles of a variety of types have also have been proposed. However, with most adjustable spray nozzles, the mechanisms by which the configurations of the nozzles are adjusted to vary their discharge spray patterns are undesirably complex and expensive. Moreover, these mechanisms tend to occupy undesirably large amounts of space.

The undesirably large sizes of previously proposed adjustable spray nozzle assemblies prohibits many of them from being used on the end of an elongate wand or the like in applications where the wand must be capable of being inserted through relatively small openings to properly position the nozzle assemblies for discharging materials to be sprayed. Accordingly, the elongate wands used in rustproofing and undercoating operations are usually provided with fixed configuration nozzles of the general type disclosed in the referenced Spraying Apparatus Case. If more than one type of fixed configuration nozzle is needed to achieve a plurality of desired spray patterns, either the wand is provided with a means of interchangeably coupling a variety of fixed-configuration nozzles to the wand, or a plurality of wands carrying a different fixed-configuration nozzles are provided for interchangeable connection to a valve-controlled spraying canister. These different fixed-configuration nozzles or wands carrying different fixed-configuration nozzles are interchanged, as needed during an application of material being sprayed, to provide the desired types of discharge spray patterns.

While adjustable spray nozzles of various forms have been proposed, there remains a need for an adjustable spray nozzle which will provide a particularly desirable type of spray pattern that is (1) relatively narrow in width, (2) relatively elongate in length, (3) relatively uniform in spray pattern width and density along its length, and (4) the length of which may be adjustably controlled.

SUMMARY OF THE INVENTION

The present invention addresses the foregoing needs and overcomes drawbacks of previous proposals by providing a novel and improved, simple and inexpensive, adjustable spray nozzle which provides a desired type of relatively narrow, elongate spray pattern. The nozzle utilizes an adjustable spray deflection member which is carried by a nozzle housing. The adjustable deflection member serves to intercept end portions of a non-uniform discharge spray pattern to deflect these intercepted portions back into center portions of the spray pattern to enhance the uniformity of the resulting spray pattern along its length, and to permit the length of the resulting spray pattern to be controlled.

A feature of adjustable spray nozzles which embody the preferred practice of the present invention is that an adjustable sleeve which perimetrically surrounds portions of a nozzle housing is utilized to provide the desired degree of spray pattern control without significantly increasing the diameter of the nozzle, whereby the nozzle can be used with an elongate wand or other suitable type support and can be inserted through relatively small openings to properly position the nozzle for discharge of material to be sprayed.

In preferred practice, an adjustable spray nozzle has an elongate tubular housing through which a gas-borne flow of liquid is ducted to a discharge opening that is formed in an end wall of the housing. The discharge opening is defined by the juncture of a transversely extending, substantially linear groove which is formed in the external face of the end wall, and a converging passage which is formed in the internal face of the end wall. The converging passage and the linear groove cooperate to provide an essentially convergent-divergent discharge opening which tends to cause materials being discharged to form an elongate discharge spray pattern that is relatively narrow in width. Materials which discharge from the opening tend to travel in a relatively narrow range of planes that align with the linear groove, and tend to concentrate near opposite end portions of the discharge spray pattern. A deflector sleeve is carried by the housing and is adjustable longitudinally relative to the end wall of the housing. The sleeve is movable within a range of extended positions wherein the sleeve projects forwardly beyond the end wall of the housing of differing extents to intercept and deflect end portions of the discharge spray to differing degrees such that opposite end portions of the discharging spray are deflected back into central portions of the spray pattern. The resulting spray pattern tends to be substantially uniform along its length, both with respect to spray pattern width and density of the material being sprayed. The length of the resulting spray pattern is determined by the position of the sleeve relative to the end wall of the housing. The greater the degree of extension of the sleeve, the shorter the length of the resulting spray pattern.

In one embodiment, the elongate housing is substantially annular in cross-section such that it defines a duct that extends through the length of the housing material to be sprayed to the vicinity of the end wall. The duct is of substantially uniform diameter and defines a central axis. The linear groove lies in a plane which includes the center axis, and the converging taper is coaxial with respect to the center axis of the duct. By this arrangement, sprayed materials are discharged in a relatively flat or narrow fan-shaped discharge spray pattern. The discharge spray pattern extends substantially symmetrically about a center plane which extends along the center axis and aligns with the groove. In an alternate embodiment, the groove is positioned slightly to one side of the center axis, or is inclined slightly with respect to the center axis, whereby the resulting spray pattern tends to discharge principally in a plane that is inclined with respect to the center axis.

BRIEF DESCRIPTION OF THE DRAWINGS

These and other features, and a fuller understanding of the invention may be had by referring to the following description and claims taken in conjunction with the accompanying drawings, wherein:

DESCRIPTION OF THE PREFERRED EMBODIMENT

Figure 1:
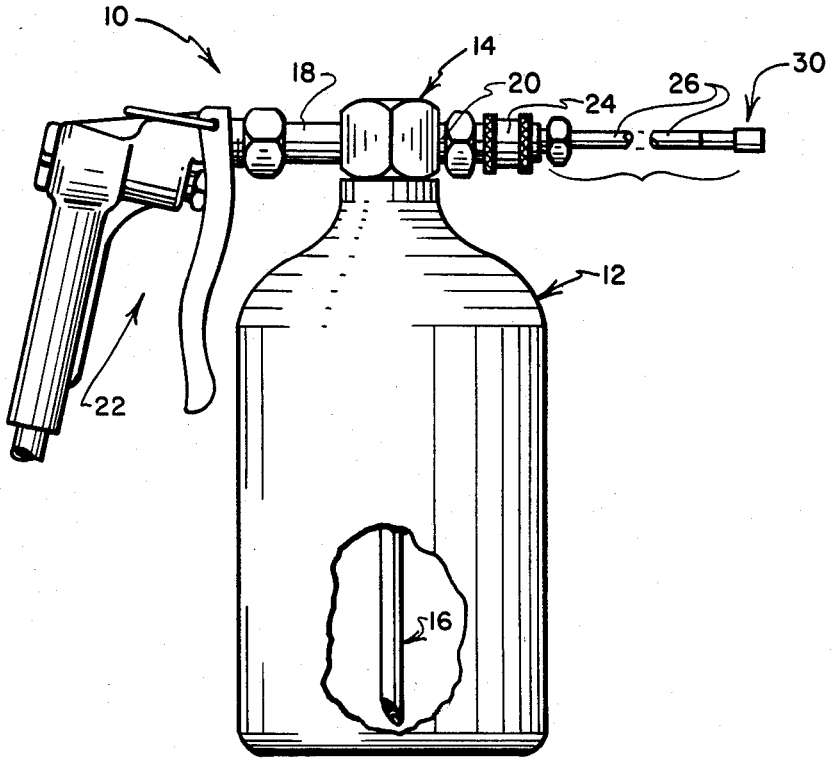
FIG. 1 is a side elevational view of a spraying apparatus which utilizes one embodiment of an adjustable spray nozzle that incorporates features of the present invention, with wand portions of the apparatus foreshortened, and with canister portions of the apparatus broken away to permit internal details to be viewed.
Figure 2:
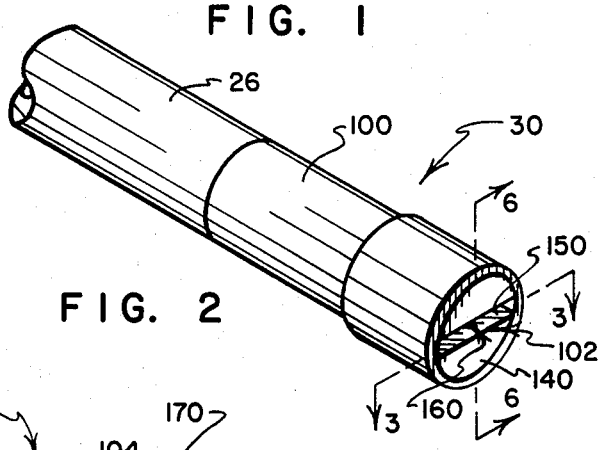
FIG. 2 is a perspective view, on an enlarged scale, of a portion of the wand and adjustable spray nozzle embodiment of FIG. 1, and with a sleeve component of the adjustable spray nozzle shown in a relatively non-extended position with respect to an end wall of the nozzle's housing.
Figure 3:
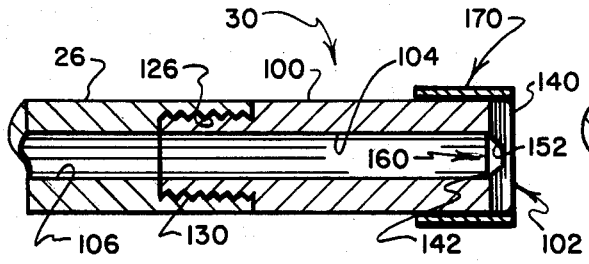
FIG. 3 is a sectional view as seen from a plane indicated by a line 3—3 in FIG. 2.

Referring to FIGS. 1–3, one embodiment of an adjustable spray nozzle incorporating features of the invention is shown connected to a spray apparatus which is indicated generally by the numeral 10. The apparatus 10 is of the general type described in the referenced Spraying Apparatus Case, and need not be described in detail inasmuch as the disclosure of the Spraying Apparatus Case is incorporated herein by reference.

The apparatus 10 includes a trigger-operated valve assembly 22 which is located upstream from a spray solution reservoir vessel or canister 12. The trigger-operated valve assembly 22, is preferably of the general type described in U.S. Pat. Nos. 3,756,273, 3,632,046 and 2,072,555, the disclosures of which are also incorporated herein by reference.

By locating the control valve assembly 22 upstream from the vessel 12, the vessel 12 is caused to be pressurized by a supply of gas only when the valve assembly 22 is operated to effect spraying. An advantage of this type of arrangement is that the vessel 12 is maintained at ambient pressure when spraying is not in progress, whereby the vessel 12 can be opened for refilling without concern that its contents are pressurized. However, as is described in the referenced Spraying Apparatus Case, the control valve assembly 22 may also be located downstream from the vessel 12, whereby the vessel 12 is normally maintained in a pressurized mode. An advantage of this type of arrangement is that an immediate "instant on, instant off" spraying control is provided by the control valve assembly 22.

The spray apparatus 10 additionally includes a plug assembly 14 which is secured atop the upstanding pressure vessel 12. A suction tube assembly 16 depends from the plug assembly 14 into the vessel 12 for ducting solution from vessel 12 during spraying. An inlet conduit 18 and an outlet conduit 20 communicate with the plug assembly 14, as is described in the referenced Spraying Apparatus Case. The control valve assembly 22 communicates the inlet conduit 18 with a source of pressurized gas (not shown) for selectively admitting pressurized gas to the vessel 12. A conventional quick-disconnect coupler 24 connects one end of an elongate discharge tube or wand 26 with the outlet conduit 20.

In order to charge the vessel 12 with liquid to be sprayed, the plug assembly 14 is removed from the neck of the vessel 12 to permit a sprayable liquid (not shown) to be poured into the vessel 12. The plug assembly 14 is then reconnected to the neck of the vessel 12, and a source of pressurized gas (not shown) is connected to the control valve assembly 22 to enable spraying to begin. The vessel 12 remains unpressurized until the control valve assembly 22 is operated. When the control valve assembly 22 is operated, pressure within the vessel 12 operates to deliver liquid into the suction tube assembly 16, as is described in detail in the referenced Spraying Apparatus Case. The foregoing reference numerals correspond with those utilized in the referenced Spraying Apparatus Case to facilitate reference thereto.

As is also disclosed in the referenced Spraying Apparatus Case, a discharge nozzle, indicated in the drawings of the present application by the numeral 30, is provided on the tip end of the discharge wand 26 for discharging a mixture of gas and liquid from the vessel 12 in a controlled spray pattern. However, unlike the fixed configuration discharge nozzle which is disclosed in the referenced Spraying Apparatus Case, the nozzle 30 is adjustable, as will be described, to provide a relatively narrow, elongate discharge spray pattern, the length of which can be controlled to provide a resulting spray pattern of desired length which is substantially uniform along its length, both with respect to width and density of material being sprayed.

Before turning to a description of the structure and operation of the nozzle 30, definitions of two terms used in the description are needed. What is meant by the term "discharge spray pattern" is a relatively non-uniform pattern of spray which discharges from a discharge opening 160, as will be described later. What is meant by the term "resulting spray pattern" is the relatively uniform pattern of spray which ultimately issues from the nozzle 30 after the "discharge spray pattern" has been partially intercepted and deflected by an adjustable deflector sleeve 170, as will be described later. Thus, it will be understood that the "discharge spray pattern" is operated upon by the adjustable deflector sleeve 170 and modified to form the "resulting spray pattern," whereby what is ultimately delivered by the nozzle 30 to a target or other object being sprayed is the "resulting spray pattern."

Figure 6:
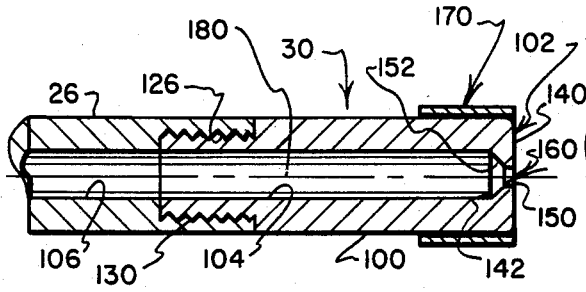
FIG. 6 is a sectional view as seen from a plane indicated by a line 6—6 in FIG. 2.

Referring to FIGS. 2, 3 and 6, the adjustable spray nozzle 30 includes a substantially tubular housing 100 having a transversely extending end wall 102. An elongate supply duct 104 is formed through the housing 100 for ducting sprayable material from a similar duct 106 which is formed in the wand 26 to the vicinity of the end wall 102. Mating threaded formations 126, 130 are provided on the wand and nozzle 26, 30, respectively, to releasably couple these elements and to provide a liquid-tight connection between the ducts 104, 106. The end wall 102 has exterior and interior faces 140, 142, respectively. As is best seen in FIG. 2, the groove 150 extends across the full width of the exterior face 140 and has opposed ends opening through opposed edges of the exterior face 140. A linear groove 150 is formed in the exterior face 140. A tapered passage 152 is formed in the interior face 142. The groove 150 and the tapered passage 152 cooperate to define a convergent-divergent discharge opening, indicated generally by the numeral 160.

An adjustable deflector sleeve 170 forms a band-like structure circumferentially extending about portions of the cylindrical outer wall of the housing 100 and closing opposed ends of the groove 150. In FIG. 3, the sleeve 170 is shown in a relatively non-extended position with respect to the end wall 102 of the housing 100. When the sleeve 170 is in the position illustrated in FIG. 3, it does little if anything to interfere with the discharge spray pattern which results as material being sprayed discharges through the discharge opening 160.

Figure 8:
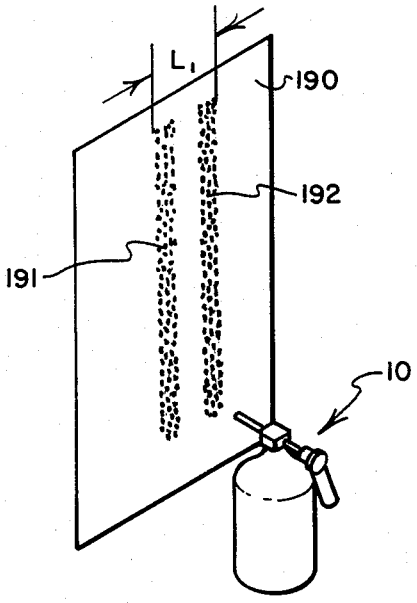
FIGS. 8, 9 and 10 illustrate spray patterns which result through the utilization of the adjustable sleeve settings which are shown in FIGS. 3, 4 and 5, respectively; and, FIG. 11 is a sectional view similar to FIGS. 4 and 5, but on an enlarged scale, showing still another alternate embodiment of adjustable spray nozzle which incorporates features of the present invention.

Referring to FIG. 8, a vertically upstanding target 190 is shown which has received material sprayed from the apparatus 10 with the sleeve 170 of the nozzle 30 positioned as shown in FIG. 3 (with the groove 150 of the nozzle 30 oriented horizontally), and with the apparatus 10 being moved vertically downwardly while spraying is taking place with the wand 26 and the nozzle 30 extending in a direction that is perpendicular relative to the plane of the target 190. The type of "resulting spray pattern" which is obtained with the sleeve 170 positioned as shown in FIG. 3 is, in essence, the "discharge spray pattern" which would result from the use of the nozzle 30 without the sleeve 170. The pattern has a length $L_1$ and is non-uniform along its length inasmuch as material being sprayed tends to concentrate toward opposite ends of the spray pattern, causing the apparatus 10 to produce, in effect, two side-by-side stripes 191, 192 as it is moved vertically downwardly while spraying toward the target 190.

Figure 4:
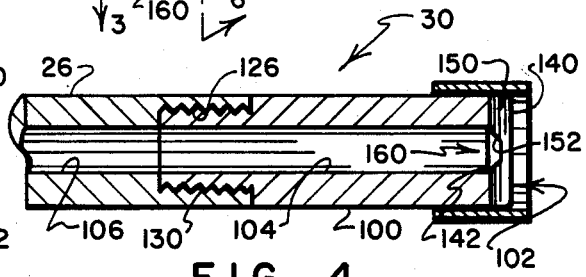
FIGS. 4 and 5 are sectional views similar to FIG. 3 but illustrating the adjustable spray nozzle with its sleeve in progressively more extended positions with respect to the end wall of the housing.
Figure 5:
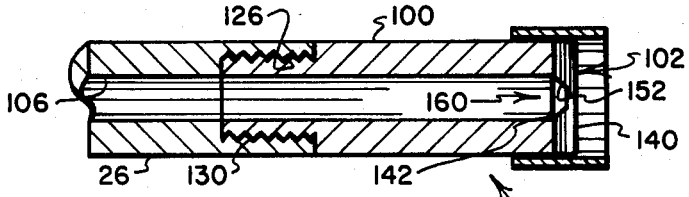

Referring to FIGS. 4 and 5, when the sleeve 170 is extended to differing degrees with respect to the housing end wall 102, the inner walls of the sleeve 170 intercept and deflect end portions of the discharge spray pattern, causing intercepted end portions of the discharging spray to be deflected back into the central portion of the discharging spray, whereby the resulting spray pattern is caused to be substantially uniform along its length, both with respect to width and density.

Figure 9:
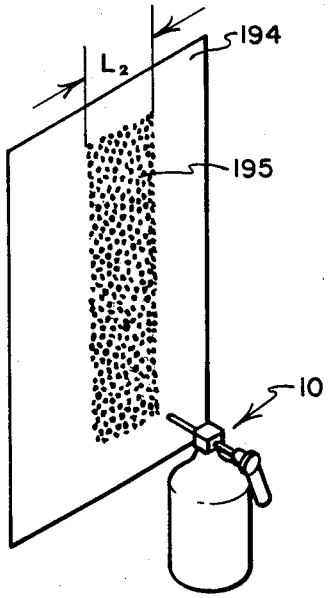
Figure 10:
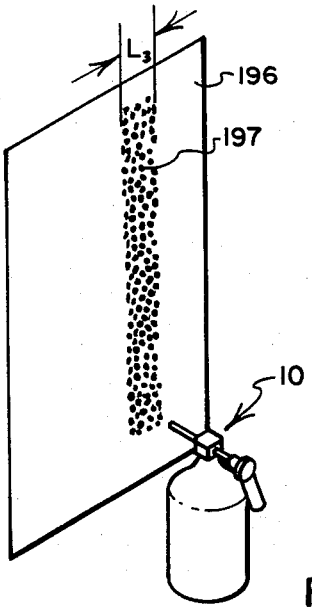

Referring to FIG. 9, a target 194 is shown bearing a single uniform stripe 195 of sprayed material which results when the sleeve 170 is positioned to project only a relatively small distance beyond the housing end wall 102, as shown in FIG. 4. The resulting spray pattern has a length $L_2$. Similarly, referring to FIG. 10, a target 196 is shown bearing a single uniform stripe 197 of sprayed material which results when the sleeve 170 is extended to project farther beyond the housing end wall 102, as depicted in FIG. 5, such that inner walls of the sleeve 170 intercept and deflect more of the end portions of the discharge spray pattern, causing a resulting spray pattern that is relatively uniform and has a length $L_3$. As will be apparent from comparisons of the stripes 195, 197 on the targets 194, 196, the farther the sleeve 170 is extended to project beyond the end wall 102 of the nozzle housing 100, the narrower are the lengths of the resulting spray patterns, as reflected by the widths $L_2$, $L_3$ of the stripes 195, 197.

Referring to FIG. 6, the nozzle 30 has its discharge opening 160 in alignment with and extending coaxially along a central axis 180 which is defined at the center of the aligned delivery ducts 104, 106. The nozzle embodiment 30 has its linear end wall groove 150 extending in a plane which includes the axis 180 and which parallels the length of the groove 150.

Figure 7:
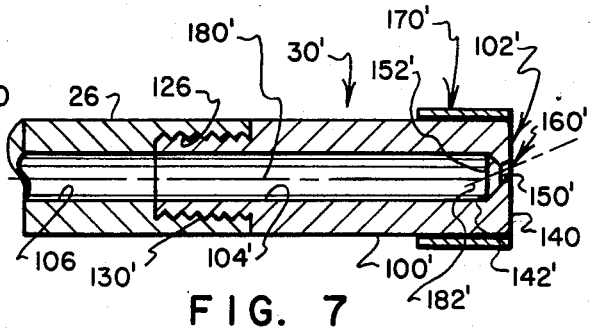
FIG. 7 is a sectional view similar to FIG. 6 but showing an alternate embodiment of adjustable spray nozzle which incorporates features of the present invention.

Referring to FIG. 7, an alternate nozzle embodiment 30' is depicted. In illustrating the nozzle embodiment 30', the same numerals used in describing the nozzle embodiment 30 have been used, but with "prime" marks, to indicate corresponding parts of the nozzles 30, 30'. The nozzle 30' utilizes a linear end wall groove 150' that is positioned slightly to one side of the axis 180', and which is inclined with respect to the axis 180'. The plane of the groove 150' is indicated by the numeral 182'. The differences in the spray patterns which result through the use of the nozzles 30, 30', have to do with the directions that the resulting spray patterns take with respect to the axes 180, 180'. With the nozzle 30, the resulting spray pattern discharges from the nozzle 30 in a direction which is symmetrical about a plane that includes the axis 180. With the nozzle 30', however, the resulting spray pattern discharges principally about the plane 182'.

Figure 11:
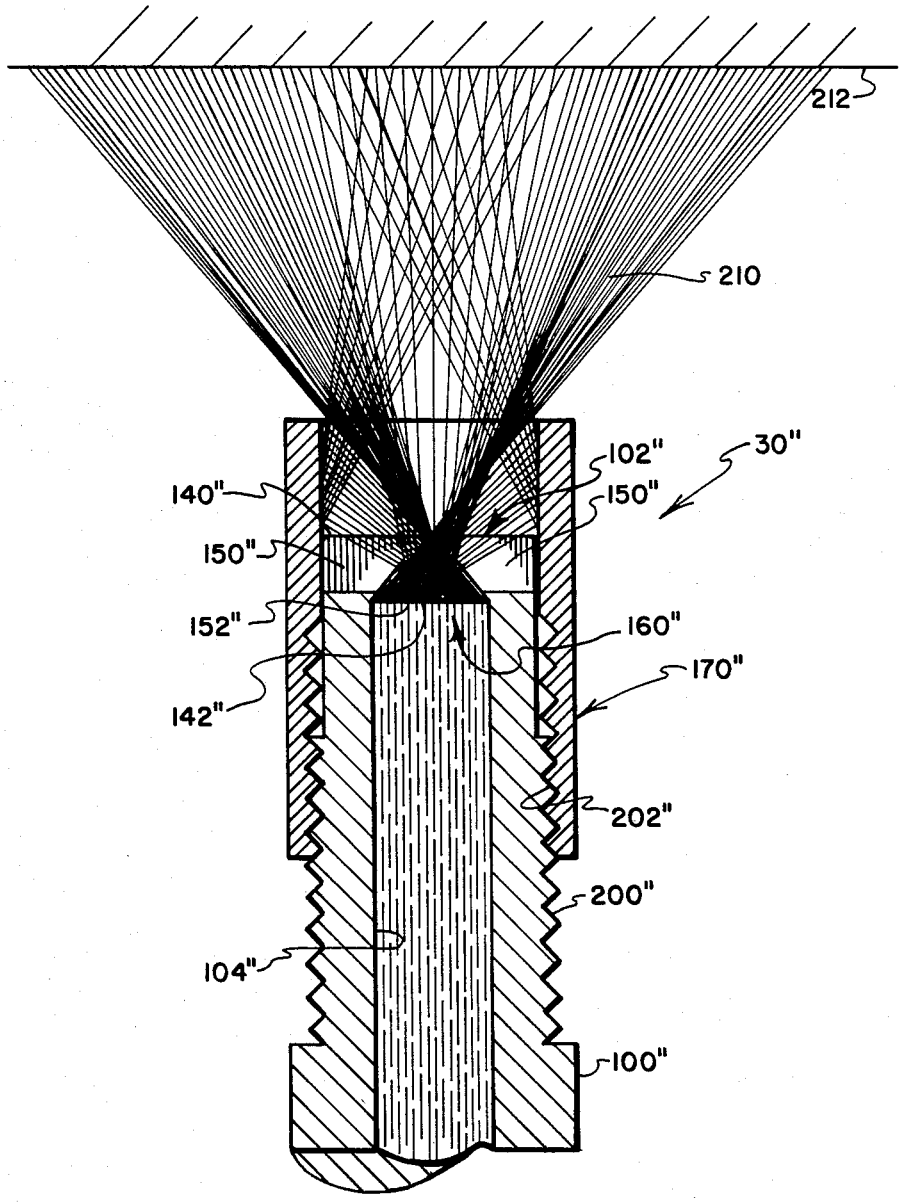

Referring to FIG. 11, still another embodiment of adjustable spray nozzle 30'' includes a substantially tubular housing 100'' having a transversely extending end wall 102''. An elongate supply duct 104'' is formed through the housing 100'' for ducting sprayable material to the vicinity of the end wall 102''. The end wall 102'' has exterior and interior faces 140'', 142'', respectively. A linear groove 150'' is formed in the exterior face 140''. A tapered passage 152'' is formed in the interior face 142''. The groove 150'' and the tapered passage 152'' cooperate to define a convergent-divergent discharge opening, indicated generally by the numeral 160''.

An adjustable deflector sleeve 170'' forms a band-like structure circumferentially extending about portions of the cylindrical outer wall of the housing 100''. Interfitting threaded formations 200'', 202'' are provided on the housing 100'' and on the sleeve 170'' to adjustably interconnect these elements. The deflector sleeve 170'' is shown in an extended position wherein the inner walls of the sleeve 170'' intercept and deflect end portions of the discharge spray pattern, causing intercepted end portions of the discharging spray to be deflected back into the central portion of the discharging spray. The resulting spray pattern is caused to be substantially uniform along its length, both with respect to width and density, as is illustrated schematically in FIG. 11 by a spray 210 which is depicted as discharging onto a target 212. As has been described in conjunction with the sleeve 170, the farther the sleeve 170" is extended to project beyond the end wall 102" of the nozzle housing 100", the shorter is the length of the resulting spray pattern.

As will be apparent from the foregoing description, a feature of the present invention lies in a novel method for providing a substantially uniform elongate resulting spray pattern wherein a non-uniform discharge spray pattern is operated on by a deflector sleeve or similar structure. A further feature lies in a novel method for controlling the length of a uniform resulting spray pattern.

Although the invention has been described in its preferred form with a certain degree of particularity, it is understood that the present disclosure of the preferred form has been made only by way of example and numerous changes in the details of construction and the combination and arrangement of parts may be resorted to without departing from the spirit and scope of the invention as hereinafter claimed. By way of but one example, while deflector sleeves 170, 170" have been illustrated which are held in place by friction and by a threaded connection, respectively, other types of adjustable connections can be provided between a nozzle housing and a suitably configured deflector. Accordingly, it is intended that the patent shall cover, by suitable expression in the appended claims, whatever features of patentable novelty exist in the invention disclosed.

What is claimed is:

1. An adjustable spray nozzle for providing a relatively narrow, elongate, and substantially uniform resulting spray pattern for materials issuing therefrom, with the length of the resulting spray pattern being controllable, the nozzle comprising:

(a) an elongate cylindrical tubular housing having a transversely extending end wall near one end thereof with the end wall having an exterior face and an interior face, and means defining a discharge opening therefrom formed through the end wall from the interior face thereof to the exterior face thereof, and the housing having structure which defines an elongate delivery passage for ducting material to be sprayed along a path extending longitudinally through the housing to the interior face for discharge through the discharge opening;

(b) the means defining the discharge opening including an elongate, substantially linear groove formed in the exterior face of the end wall, the groove being continuous along its length and extending from one edge of the exterior face to an opposite edge thereof and having opposed ends which open through the one and opposite edges, and a converging passage formed in the interior face of the end wall, with the groove and the converging passage intersecting and cooperating to define the discharge opening for discharging sprayed materials in a relatively narrow, elongate, but non-uniform type of discharge spray pattern which extends in planes that align with the linear groove, with the discharging materials tending to be concentrated toward opposed end regions of the discharge spray pattern, and with relatively lesser amounts of the discharging materials being present in central portions of the discharge spray pattern;

(c) band-like cylindrical spray deflector means carried by the housing for closely surrounding and closing the opposed ends of the linear groove where the opposed ends of the groove open through the one and opposite edges of the exterior face, and for extending beyond the end wall at locations near the opposed ends of the linear groove to intercept additionally end portions of the discharge spray pattern and to deflect intercepted discharging materials back into central portions of the discharge spray pattern such that a resulting spray pattern of material issuing from the nozzle is caused to be substantially uniform along its length from one end portion thereof through central portions thereof to the other end portion thereof; and, (d) connection means adjustably mounting the spray deflector means on the housing for axial movement between positions wherein the spray deflector means intercepts end portions of the discharge spray pattern to differing degrees, whereby the length of the resulting spray pattern may be controlled by controlling the extent to which the spray deflector means intercepts end portions of the discharge spray pattern.

2. The adjustable spray nozzle of claim 1 wherein the connection means includes interfitting threads carried on the band-like deflector means and on the portion of the elongate housing which is surrounded by the band-like deflector means.

3. The adjustable spray nozzle of claim 1 wherein the linear groove extends within a plane which is inclined with respect to the center axis of said discharge opening.

* * * * *